US005334958A

United States Patent [19]

Babbitt et al.

[11] Patent Number: 5,334,958

[45] Date of Patent: Aug. 2, 1994

[54] MICROWAVE FERROELECTRIC PHASE SHIFTERS AND METHODS FOR FABRICATING THE SAME

[75] Inventors: Richard W. Babbitt, Fairhaven; Thomas E. Koscica, Clark; William C. Drach, Trenton, all of N.J.

[73] Assignee: The United States of America as represented by the Secretary of the Army, Washington, D.C.

[21] Appl. No.: 89,065

[22] Filed: Jul. 6, 1993

[51] Int. Cl.[5] ..... H01P 1/18

[52] U.S. Cl. ..... 333/156; 333/161

[58] Field of Search ..... 333/156, 158, 161, 164, 333/138–140, 246, 125, 128, 136; 342/371–375; 343/700 MS, 853, 858, 778

[56] References Cited

U.S. PATENT DOCUMENTS

| | | | |
|---|---|---|---|
| 4,105,959 | 8/1978 | Stachejko | 333/161 |
| 5,032,805 | 7/1991 | Elmer et al. | 333/156 |
| 5,162,803 | 11/1992 | Chen | 342/375 X |
| 5,223,808 | 6/1993 | Lee et al. | 333/161 X |

FOREIGN PATENT DOCUMENTS

| | | | |
|---|---|---|---|
| 0778606 | 7/1988 | U.S.S.R. | 333/161 |

*Primary Examiner*—Seungsook Ham

*Attorney, Agent, or Firm*—Michael Zelenka; William H. Anderson

[57] ABSTRACT

A ferroelectric phase shifter, especially for the X-band, may be made from an elongated slab of ferroelectric material, which has a high dielectric constant that can be varied by applying an electric field. A narrow signal conductor is formed extending across a first surface of the slab, and a ground plane conductor is formed an opposite surface, forming a microstripline. An overall RF phase shifting circuit can be made by forming input and output circuits corresponding to the above-described signal conductor and interposing and connecting the signal conductor between the input and output circuits. The input and output circuits can be formed on respective, discrete substrates, with the ferroelectric slab being interposed between the substrates, or the input and output circuits can be formed on a common substrate, with the ferroelectric material inserted into a slot formed in the common substrate.

11 Claims, 5 Drawing Sheets

69
67
66
64
60
52d
52c
52b
52a
62
60d
60c
60b
60a

MICROWAVE FERROELECTRIC PHASE SHIFTERS AND METHODS FOR FABRICATING THE SAME

STATEMENT OF GOVERNMENT INTEREST

The invention described herein may be manufactured, used, and licensed by or for the Government for governmental purposes without the payment to the inventors of any royalty thereon.

BACKGROUND OF THE INVENTION

1. Field of the Invention

This invention relates to structures and fabricating methods for microwave ferroelectric phase shifters.

One aspect of the invention relates to a fabrication technique wherein a ferroelectric phase shifter element is formed on an easy-to-handle slab of ferroelectric material, and the product thus obtained. A further aspect of the invention relates to an assembly comprising a plurality of ferroelectric phase shifter elements all formed on a common slab of ferroelectric material, which can thereby be commonly inserted into a plurality of phase shifter circuits.

The invention reduces fabrication costs, eases the assembly process, and produces a more uniform microwave ferroelectric phase shifter. This invention will find applications at all microwave frequencies, but is expected to have an impact especially at frequencies above 10 GHz, where current assembly methods are expensive and uniform phase shifter performance is difficult to achieve.

More particularly, the invention will reduce the difficulty in handling, metallizing, and positioning small, fragile pieces of ferroelectric material. By fabricating several phase shifters on a single piece of ferroelectric material, the multiple phase shifters thus obtained can be expected to find applications in electronic scanning antennas, where from several tens to several thousands of phase shifters are required in each antenna. This invention solves the problem of individually fabricating and assembling phase shifters, for microwave systems which require many phase shifters. This invention will reduce the cost when several phase shifters are required, and produce more uniform performance by eliminating assembly variations.

2. Background Art

Ferroelectric phase shifters are used to control the amount of phase shift of a microwave signal, by varying the permittivity of the ferroelectric material. The permittivity can be controlled by an applied electric field. A phase shifter of background interest is disclosed in U.S. Pat. No. 5,032,805. Because of the high dielectric constant of ferroelectric materials, these phase shifters are very small devices, and become increasingly smaller at higher frequencies. Ferroelectric phase shifter dimensions above 10 GHz are of the order of a few mils, one mil being equal to about 0.0254 mm, which makes them difficult to handle. Breakage is common when positioning the ferroelectric into the phase shifter circuit.

Previous microstrip ferroelectric phase shifters have used a ferroelectric rod as the active phase shifting element. FIG. 1 shows a known ferroelectric phase shifter circuit 12, which uses a rod 10 made of barium strontium titanate ferroelectric material having a dielectric constant of, for example, between 100 and 6000. The rod 10 is arranged in a hole 14 which is cut in the dielectric substrate 16 to enable the rod 10 to be positioned in the circuit 12. If the material has a nominal dielectric constant of 800, for example, the size of the rod required to produce 360 degrees of phase shift at 10 GHz is 0.008″×0.010″×0.45″. It is difficult to position such a small rod consistently in the phase shifter circuit. Experience has shown that breakage is a common occurrence during the positioning process. For higher frequency applications, the task of handling the ferroelectric rods will be even more difficult; at 30 GHz the dimensions of the rod become 0.003″×0.0035″×0.15″.

Other phase shifting circuits of interest are shown in U.S. Ser. No. 07/916,741 filed Jul. 22, 1992 (U.S. Pat. No. 5,212,463) and U.S. Pat. No. 4,105,959. The disclosures of these and all other prior art information mentioned herein is expressly incorporated by reference.

A known type of electronic scanning antenna, shown in FIG. 2, uses an individual ferroelectric phase shifter circuit **22*a*, 22*b*, etc., for each of a plurality of series radiating arrays 20*a*, 20*b*, etc. Each phase shifter circuit may have a DC voltage block 24, a pair of transition elements 26, and a bias voltage circuit 27, constructed and arranged in a known manner. Each phase shifter element such as a ferroelectric rod 28*a*, 28*b***, etc., must be individually positioned into the array. It would be significantly more cost-effective, and enhance performance if a multiple phase shifter element were used.

Current ferrite phase shifters cost several thousand dollars each, and require individual tuning to achieve uniform performance. Today's electronic scanning antennas use several hundreds or thousands of phase shifters, and even with lower-cost ferroelectric phase shifters now being developed, the individual handling and packaging of these will contribute to a higher cost than is desirable for many applications. The cost of ferroelectric phase shifters will be reduced by the proposed multiple phase shifters.

SUMMARY OF THE INVENTION

The techniques disclosed herein for fabricating high frequency microstrip ferroelectric phase shifters are improvements upon the known techniques for fabrication of ferroelectric phase shifter rods designed to operate below 5 GHz. It has been found to be very difficult to handle and position the small ferroelectric rods required for frequencies above 10 GHz. Using a ferroelectric with a dielectric constant of 800, the size of the ferroelectric rod that would be needed to produce 360 degrees of phase shift at 10 GHz is 0.008″×0.010″×0.45″.

The present inventors have realized that a 10 GHz phase shifter would be difficult to fabricate with any consistency. Because of that problem, the inventors saw that at much higher frequencies, ferroelectric phase shifters using dielectric rods would be economically impractical to fabricate. The disclosed fabrication technique overcomes the difficulty of handling and positioning small fragile pieces or rods of ferroelectric, by using instead a larger metallized slab of ferroelectric material, upon which, before or after positioning the slab in a microstrip circuit, a patterned active ferroelectric phase shifter section is formed, for example by being etched from a metallized surface of the ferroelectric slab. This proposed fabrication procedure allows the very small dimensions to be controlled by the width of the patterned conductor circuit. Further, the thin ferroelectric slabs are more easily handled than small individual ferroelectric rods.

Also disclosed is a multiple phase shifter in which a plurality of phase shifters are formed as a single unit, using a fabrication process compatible with current planar technology. Since this multiple phase shifter is fabricated on a single piece of material, it is easier to maintain uniform performance than with prior art apparatus.

Other features and advantages of the present invention will become apparent from the following description of embodiments of the invention, with reference to the accompanying drawings.

DETAILED DESCRIPTION OF EMBODIMENTS OF THE INVENTION

Figure 1:
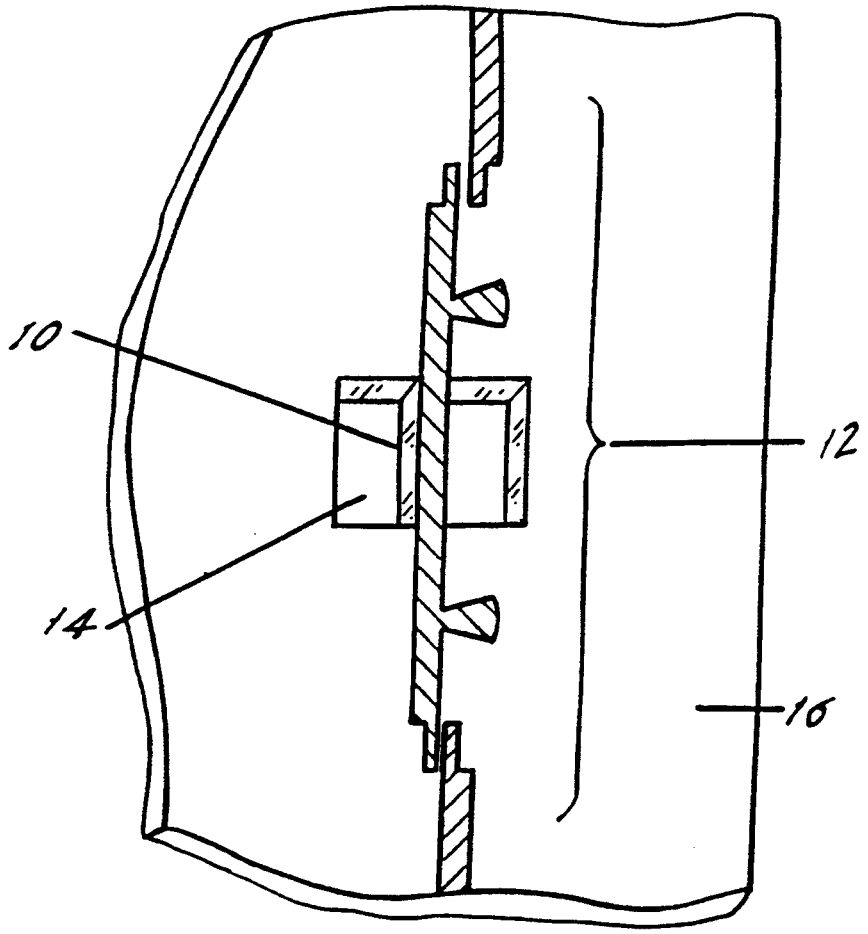
FIG. 1. PRIOR ART
FIG. 1 shows a conventional ferroelectric phase shifter using a ferroelectric rod as an active element.
Figure 5:
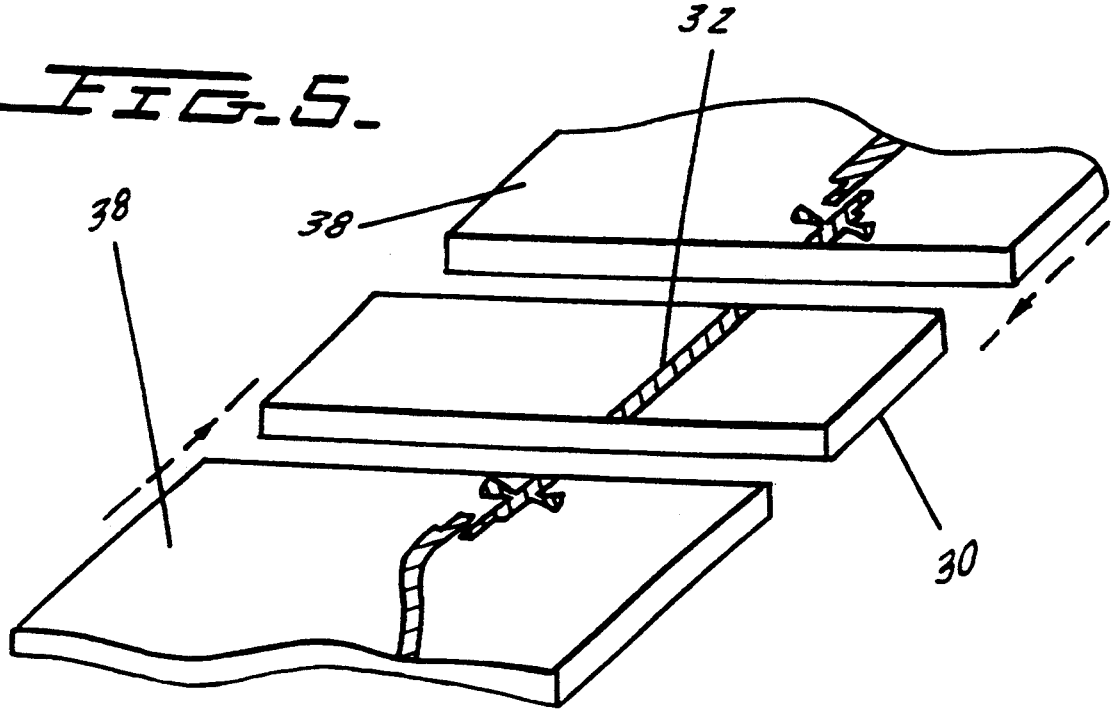
FIG. 5 shows a step of assembling the ferroelectric slab of FIG. 4 into a phase shifting circuit.
Figure 3:
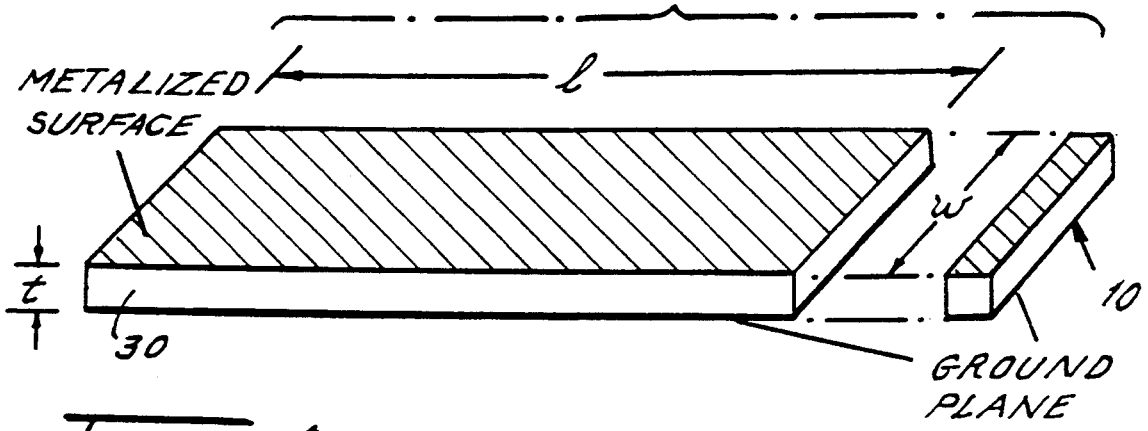
FIG. 3 shows a conventional ferroelectric rod, next to a ferroelectric slab which can be used in a fabrication method according to an aspect of this invention.
Figure 4:
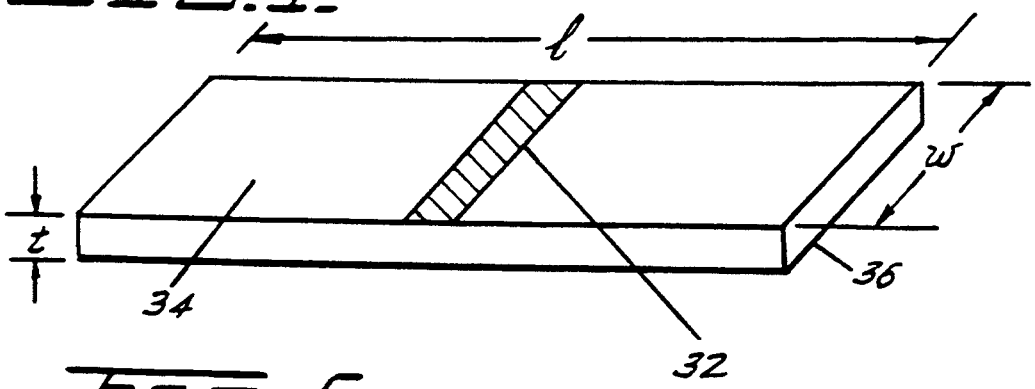
FIG. 4 shows the ferroelectric slab, after an active phase shifting region has been formed by forming a patterned conductor on a top major surface of the ferroelectric slab, and a ground plane on a bottom major surface.

A method of assembling ferroelectric phase shifters according to a first aspect of the present invention overcomes many of the size problems of prior art ferroelectric rods. As shown in FIGS. 3–5, the fabrication method replaces the ferroelectric rod with a metallized ferroelectric slab. The slab 30 is employed in the disclosed method. A prior art ferroelectric rod 10 is shown at the right side of FIG. 3. The thickness (t) of the slab 30 and the rod 10 are identical. The width (w) of the slab 30 is equal to the length of the rod, and the length of the slab (l) can be any convenient size which is easy to handle and is compatible with the phase shifter circuit.

The active phase shifting section within the ferroelectric slab is determined by the width of a patterned conductor 32 which in this non-limiting example may be etched from the top metallized surface of the slab, as shown in FIG. 4, leaving exposed ferroelectric surfaces 34. An opposite side of the slab 30 remains metallized so as to create a ground plane 36.

This method makes it possible to produce small (high frequency) ferroelectric phase shifter sections, limited only by photolithography processes (typically less than 0.001"), while providing a relatively large, sturdy piece of ferroelectric to handle and position in the phase shifter circuit. As seen in FIG. 5, positioning of the ferroelectric can easily be accomplished by butting two substrates 38, which bear respective sections of phase shifter circuit, against each side of the ferroelectric slab 30.

A second aspect of the invention relates to a multiple ferroelectric phase shifter which comprises a plurality of phase shifters formed on a single slab which can be incorporated simultaneously into a plurality of arrays in a scanning antenna, for example. The multiple ferroelectric phase shifter proposed for this purpose is formed from a rectangular slab 50 of ferroelectric material, as seen in FIG. 6, which has a width (w) equal to the length of the individual phase shifters shown in FIG. 2; a length (l) which is long enough to span all the feed lines 29 of the array, and a thickness (t) which is the same as the thickness of the individual phase shifters in FIG. 2.

Figure 6:
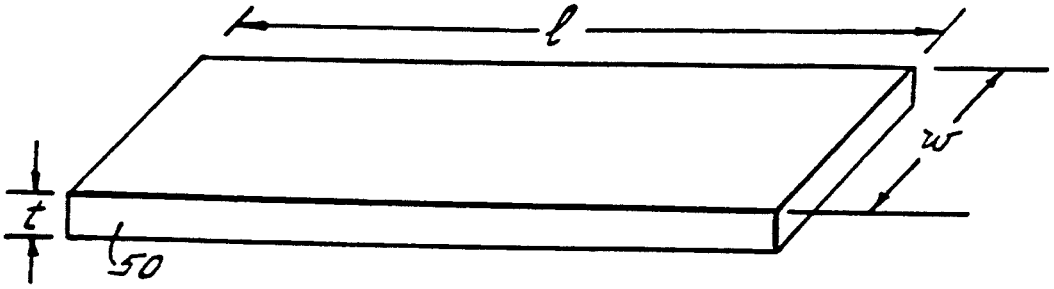
FIG. 6 shows a bar of ferroelectric material that can be used in a fabrication method according to another aspect of the invention.
Figure 7:
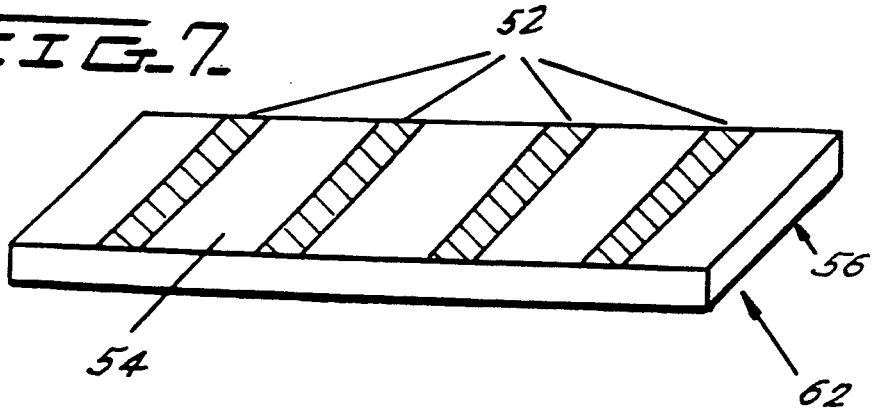
FIG. 7 shows the ferroelectric bar of FIG. 6, after formation thereon of a multiple ferroelectric phase shifter, formed by forming several microstrip conductors on one major surface, and a ground plane on the other major surface.

The ferroelectric material slab 50 in FIG. 6 is metallized, top and bottom, after which microstrip lines 52 having the proper width (as determined by known calculations) are patterned onto the top surface, as shown in FIG. 7, forming the multiple ferroelectric phase shifter element. The striplines 52 are separated by exposed ferroelectric material 54, and a ground plane 56 is formed on the opposite side of the slab 50.

The high dielectric constant of the ferroelectric material (generally greater than 100) keeps the microwave signal within the immediate area of the patterned circuit, eliminating any interaction between adjacent phase shifter circuits.

Figure 2:
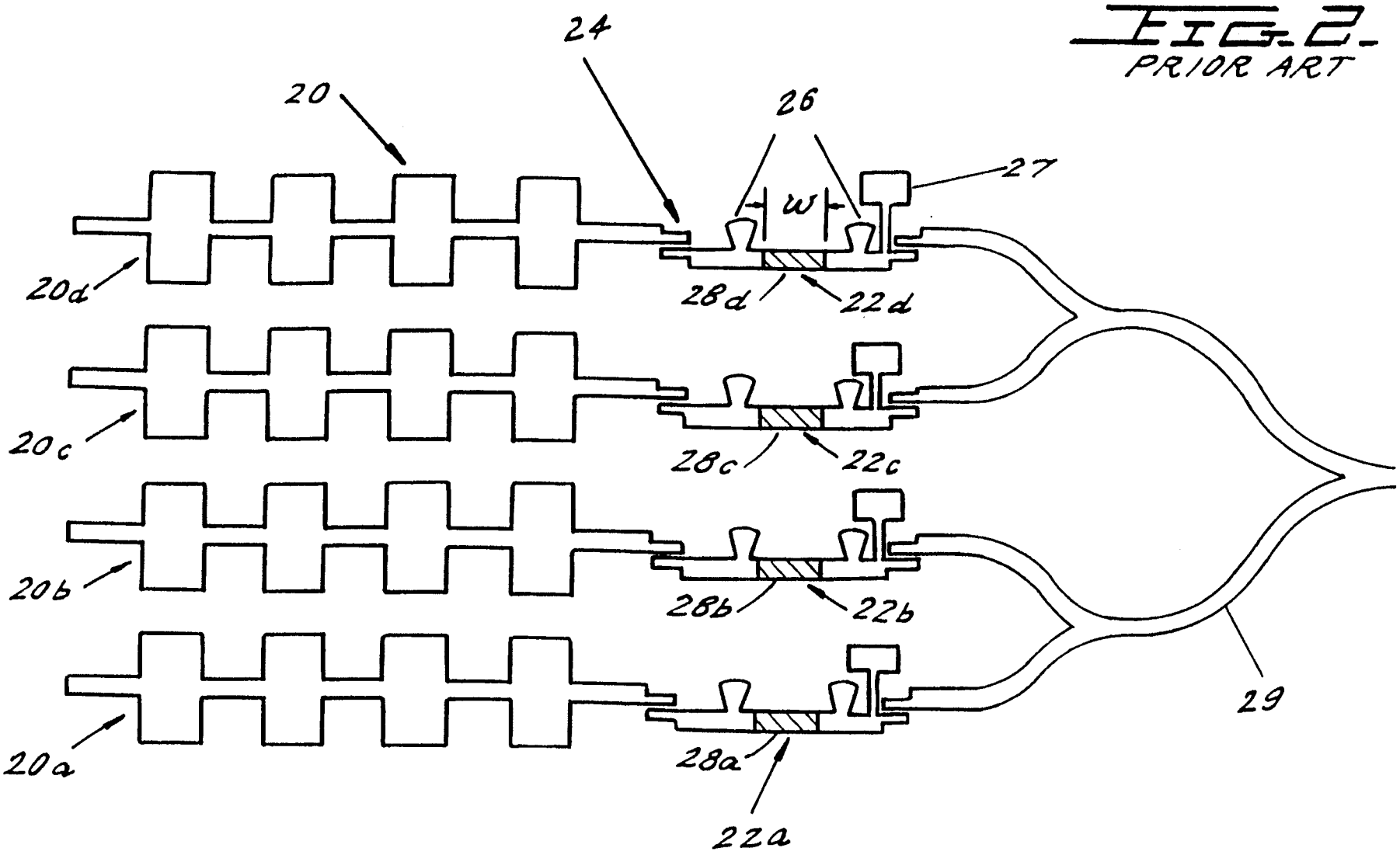
FIG. 2 PRIOR ART
FIG. 2 discloses an electronic scanning antenna including a plurality of antenna arrays, each having a respective ferroelectric phase shifter.
Figure 8:
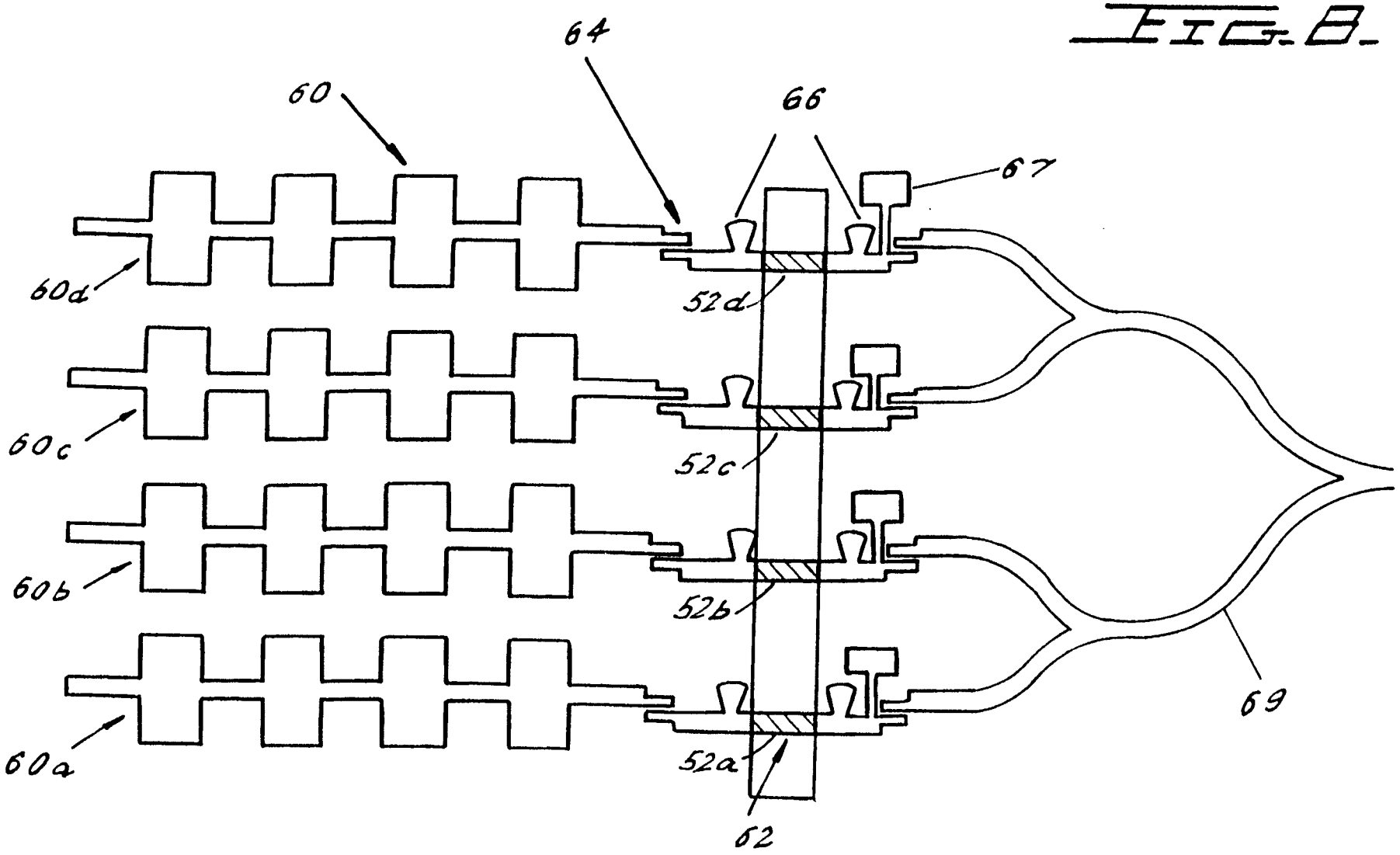
FIG. 8 shows an electronic scanning antenna having a plurality of antenna arrays, each having a respective phase shifting circuit, the active elements of all of the phase shifting circuits being provided by a multiple phase shifter according to FIG. 7.

The multiple ferroelectric phase shifter 62 of FIG. 7, when positioned in the antenna array circuit, forms an electronic scanning antenna of the type shown in FIG. 2. This multiple ferroelectric phase shifter circuit and assembly is seen in FIG. 8. Although not shown, each RF phase shifter circuit is associated with a known arrangement for applying an electric field to the ferroelectric rod so as to adjust its permittivity and thereby adjust the phase of a signal which the circuit 22, 32 receives from the feed network 29, 69 and passes through to the antenna array 20, 60. The disclosed arrangment results in a simpler, more cost-effective version of the electronic scanning antenna of the type shown in FIG. 2.

Figure 9:
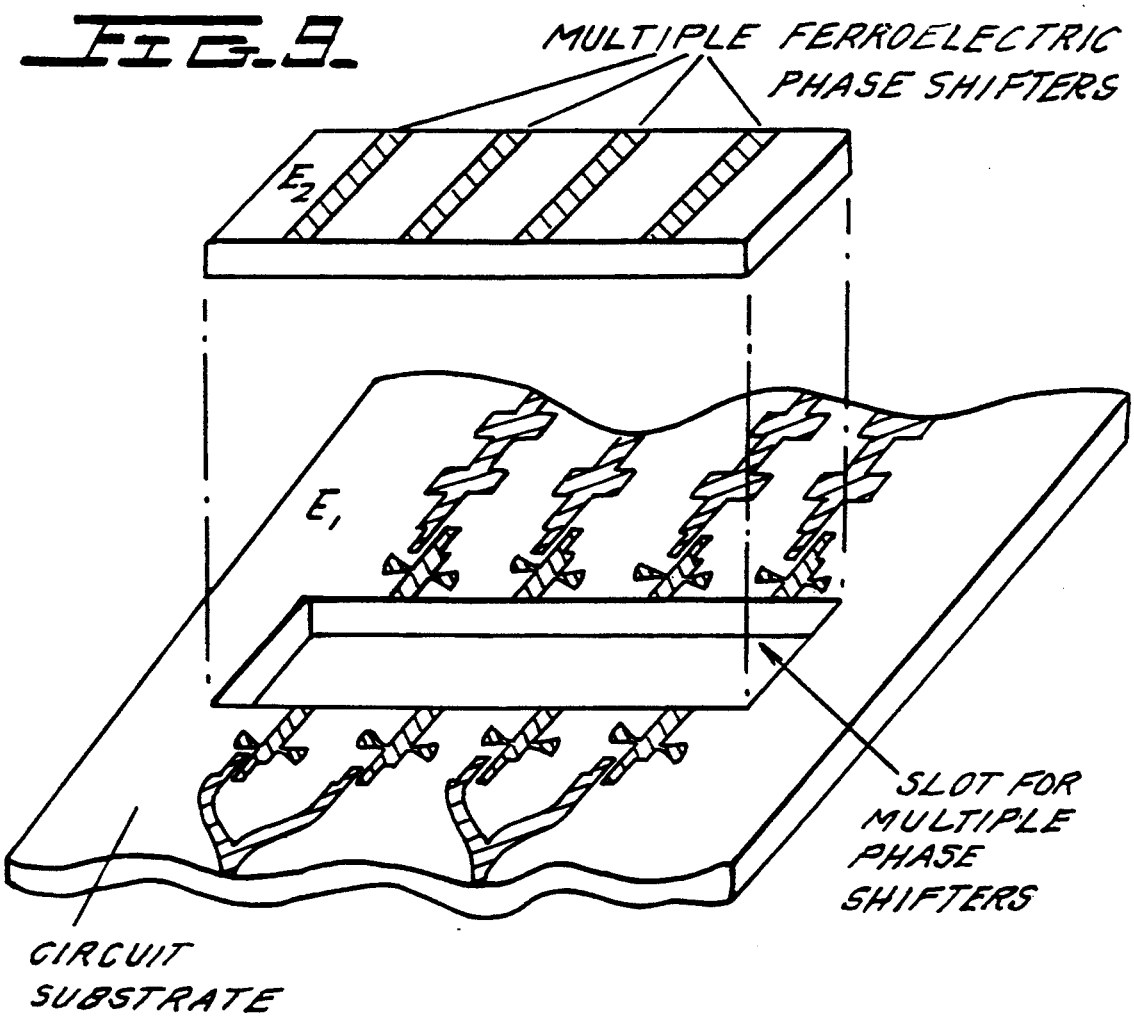
FIG. 9 shows one method of assembling the antenna array of FIG. 8.
Figure 10:
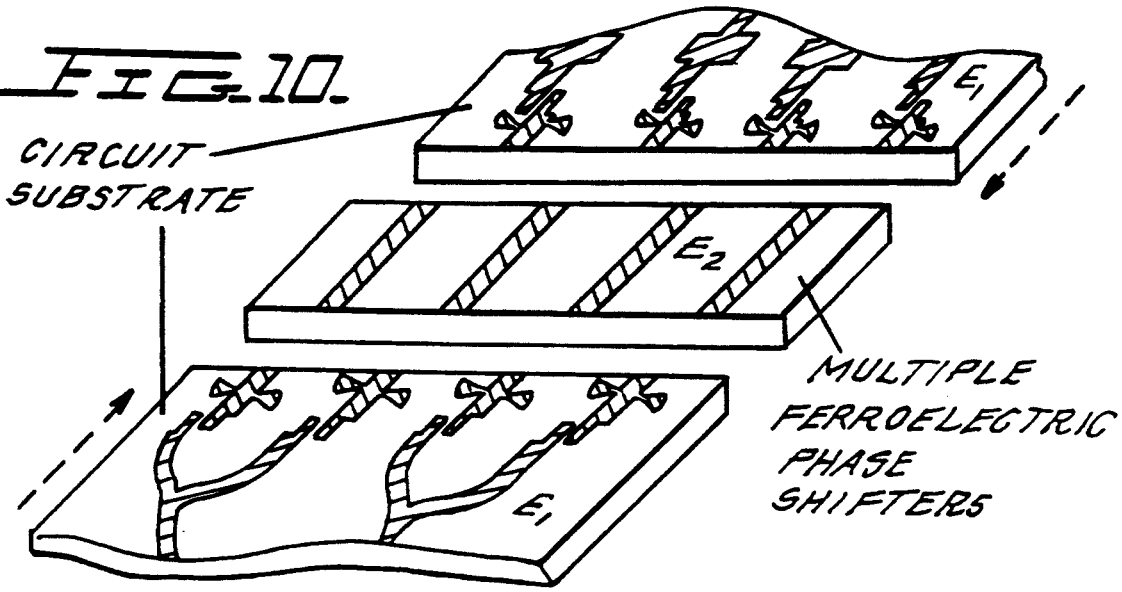
FIG. 10 shows another method of assembling the antenna array of FIG. 8.

The circuit of FIG. 8 can be assembled, either by cutting a slot into the antenna/circuit substrate, as shown in FIG. 9, for receiving and positioning the multiple phase shifter element, or by using two separate antenna/circuit substrates, FIG. 10, which are butted up against each side of the ferroelectric phase shifter element 62. A solder connection or other metallized connection is applied between the phase shifters and antenna/circuit substrates as a final assembly step.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A ferroelectric phase shifter comprising:

an elongated slab of ferroelectric material having a high dielectric constant which can be varied by applying an electric field to such material, said slab having a length, a width, and a thickness, and first and second major surfaces which are opposed to each other through said thickness of the slab;

a signal conductor formed extending across said major surface in said width direction and formed by a metallized portion of said ferroelectric material on said first major surface;

a ground plane conductor formed on a portion of said second major surface of said slab and opposite said signal conductor;

said signal conductor being narrow in said length direction and narrower than said length of said elongated slab, such that said conductor, said ground plane, and the interposed ferroelectric material form a microstripline; and input and output circuit means, said ferroelectric phase shifter being interposed between said input and output circuit means and thereby forming an RF phase shifting circuit of which the ferroelectric phase shifter forms an active element, wherein said input and output circuit means are formed on a common substrate, and said elongated ferroelectric material slab is inserted into a slot formed in said common substrate with said signal conductor on said ferroelectric slab being conductively connected to said input and output circuit means.

2. A device as in claim 1, further comprising at least one additional signal conductor formed on said first major surface of said slab so as to form an additional microstripline, thereby providing a multiple ferroelectric phase shifter.

3. A device as in claim 2, wherein the dielectric constant of said slab is sufficiently high to eliminate any substantial interaction between adjacent ferroelectric phase shifters.

4. A device as in claim 3, wherein the dielectric constant of said slab is at least about 100.

5. In combination, the device of claim 2, and further comprising a plurality of input and output circuit means, said multiple ferroelectric phase shifter being interposed between said plurality of input and output circuit means and thereby forming a respective plurality of RF phase shifting circuits of which the ferroelectric phase shifters of said multiple ferroelectric phase shifter form active elements.

6. The circuit of claim 5, wherein said multiple ferroelectric phase shifter is inserted into a slot formed in said common substrate with each of said signal conductors being conductively connected to a respective pair of said input and output circuit means.

7. A method of fabricating an RF phase shifter circuit comprising a ferroelectric phase shifter, said method comprising the steps of:

forming a ferroelectric phase shifter comprising an elongated slab of ferroelectric material having a high dielectric constant which can be varied by applying an electric field to such material, said slab having a length, a width, and a thickness, and first and second major surfaces which are opposed to each other through said thickness of the slab;

signal conductor formed extending across said major surface in said width direction and formed by a metallized portion of said ferroelectric material on said first major surface;

a ground plane conductor formed on a portion of said second major surface of said slab and opposite said signal conductor;

said signal conductor being narrow in said length direction and narrower than said length of said elongated slab, such that said conductor, said ground plane, and the interposed ferroelectric material form a microstripline;

forming input and output circuits corresponding to said ferroelectric phase shifter; and interposing said ferroelectric phase shifter between said input and output circuits with said input and output circuits being connected to said ferroelectric phase shifter, thereby forming an RF phase shifting circuit of which the ferroelectric phase shifter forms an active element;

forming said input and output circuits on a common substrate; and inserting said elongated ferroelectric material slab into a slot formed in said common substrate, with said signal conductor on said ferroelectric slab being conductively connected to said input and output circuits.

8. A method as in claim 7, further comprising the step of forming at least one additional signal conductor on said first major surface of said slab so as to form an additional microstripline, thereby providing a multiple ferroelectric phase shifter.

9. A method as in claim 8, wherein the dielectric constant of said slab is sufficiently high to eliminate any substantial interaction between adjacent ferroelectric phase shifters.

10. A method as in claim 9, wherein the dielectric constant of said slab is at least about 100.

11. A method of fabricating an RF phase shifter circuit comprising a ferroelectric phase shifter comprising the steps of:

forming a plurality of ferroelectric phase shifters each comprising an elongated slab of ferroelectric material having a high dielectric constant which can be varied by applying an electric field to such material, said slab having a length, a width, and a thickness, and first and second major surfaces which are opposed to each other through said thickness of the slab;

signal conductor formed extending across said major surface in said width direction and formed by a metallized portion of said ferroelectric material on said first major surface;

a ground plane conductor formed on a portion of said second major surface of said slab and opposite said signal conductor;

said signal conductor being narrow in said length direction and narrower than said length of said elongated slab, such that said conductor, said ground plane, and the interposed ferroelectric material form a microstripline;

forming a plurality of input and output circuits corresponding to the ferroelectric phase shifters in said plurality of ferroelectric phase shifters, and interposing said plurality of ferroelectric phase shifters between said plurality of input and output circuits and thereby forming a respective plurality of RF phase shifting circuits of which the ferroelectric phase shifters of said plurality of ferroelectric phase shifters form active elements;

forming said input and output circuits on an common substrate; and inserting said plurality of ferroelectric phase shifters into a slot formed in said common substrate, with each of said signal conductors being conductively connected to a respective pair of said input and output circuits.

* * * * *